United States Patent [19]

Wilson

[11] Patent Number: 4,534,251

[45] Date of Patent: Aug. 13, 1985

[54] STRIPPING ASSEMBLY FOR NOODLE CUTTING MACHINERY

[76] Inventor: Michael S. Wilson, 34 Overhill Rd., Melville, N.Y. 11747

[21] Appl. No.: 426,738

[22] Filed: Sep. 29, 1982

[51] Int. Cl.[3] ..... B26D 7/18

[52] U.S. Cl. ..... 83/111; 83/113; 83/118; 83/926 E

[58] Field of Search ..... 83/121, 122, 111, 113, 83/118, 926 E

[56] References Cited

U.S. PATENT DOCUMENTS 1,616,388 2/1927 Philaditakis ..... 83/168
2,081,460 5/1937 Lorentz ..... 83/122
3,033,064 5/1962 Lee ..... 83/122

FOREIGN PATENT DOCUMENTS 4537478 11/1970 China ..... 83/113

*Primary Examiner*—Donald R. Schran
*Assistant Examiner*—James Wolfe
*Attorney, Agent, or Firm*—Nims, Howes, Collison & Isner

[57] ABSTRACT

Improved stripping mechanism for noodle cutting machinery including a resilient spring support member in the shape of a "W" for positioning replaceable multi-toothed comb assemblies in operative proximity with noodle cutting rollers for stripping severed noodle product therefrom.

5 Claims, 4 Drawing Figures

STRIPPING ASSEMBLY FOR NOODLE CUTTING MACHINERY

This invention relates to improvements in noodle cutting machinery and more particularly to an improved stripping mechanism for stripping the cut strips of dough from the roller type cutting mechanism thereof.

Alimentary paste products, commonly referred to as noodles, comprise flat ribbon-like strips of dough. Such strips are cut in various widths from 1/16 of an inch up to ½ of an inch and each is usually identified by a distinct subgeneric name that is commonly used to identify a particular width product. For example, strips of dough about 1/16" in width are commonly called Angel's Hair, 3/32" strips are commonly designated as Spaghetti, ⅛" strips are commonly called Linguini and ¼" strips are commonly called Fettuccine.

The raw dough for noodles is prepared from flour and water as a rolled strip or sheet and is normally calendared to a particular thickness immediately prior to its being cut into strips. Machines for calendaring dough into strips and for cutting the dough into a multiplicity of flat ribbon-like strips of predetermined width are old in the art and are exemplified by the 1940 Ambrette U.S. Pat. No. 2,220,438. As illustrated in FIGS. 4 and 5 of Ambrette, the conventionally employed cutting technique is roll cutting wherein a pair of rollers having intermeshing lands and grooves are terminally supported in a frame and counter-rotated to deliver a plurality of separate strips of predetermined width from the underside of the nip therebetween.

Such roll cutting mechanisms also have conventionally employed stripper combs having stripper finers sized to enter the roll grooves and bear against the base surface thereof on the downstream side of the nips to strip away therefrom any of the cut dough strips that may tend to adhere thereto. As also exemplified in FIGS. 4 and 5 of Ambrette, such stripper combs have been relatively difficult to remove for cleaning, require presetting and prepositioning for operability, and require total replacement in the event of tooth breakage or the like.

This invention may be briefly described as an improved stripper comb assembly for roll cutter type noodle cutting machines and which includes, in its broad aspects, a selectively shaped resilient mounting member adapted to support readily removable stripper combs in proper position relative to the cutter rollers for stripping operations.

Among the advantages of the subject invention is the provision of an improved stripper comb assembly for noodle cutting machines that is readily and easily installed and removed in proper relation to the cutter rollers and, when installed, is both self tensioning and self aligning relative to the cutter roller grooves. Still further advantages include a stripper comb assembly that also functions as a safety guard to prevent entry of objects into the nip of adjacent rotating cutter rollers as well as providing economics of operation through permitted use of partial comb lengths in the event of tooth breakage or the like.

The primary object of this invention is the provision of an improved stripper comb assembly for noodle cutting machines.

Other objects and advantges of the subject invention will become apparent from the following portions of this specification and from the appended drawings which illustrate, in accord with the mandate of the patent statutes, a presently preferred construction for a stripper comb assembly for noodle cutting machines incorporating the principles of the invention.

Referring to the drawings.

Figure 1:
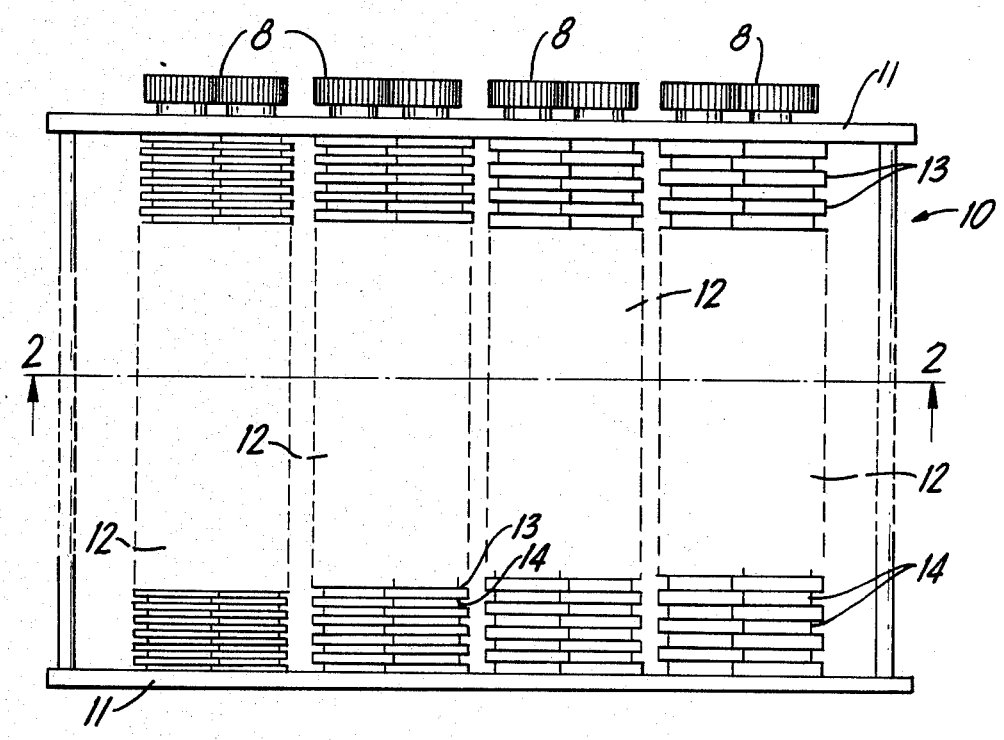
FIG. 1 is a plan view of a noodle cutting apparatus.

Referring initially to FIG. 1, an exemplary noodle cutting apparatus 10 includes a pair of parallel frame members 11 suitably journaled to support and position a plurality of pairs, suitably four, of counter-rotating roller cutters 12. The roller cutters 12 are driven through appropriate gearing 8 disposed on the outboard ends of the rollers externally of the frame 11.

Figure 2:
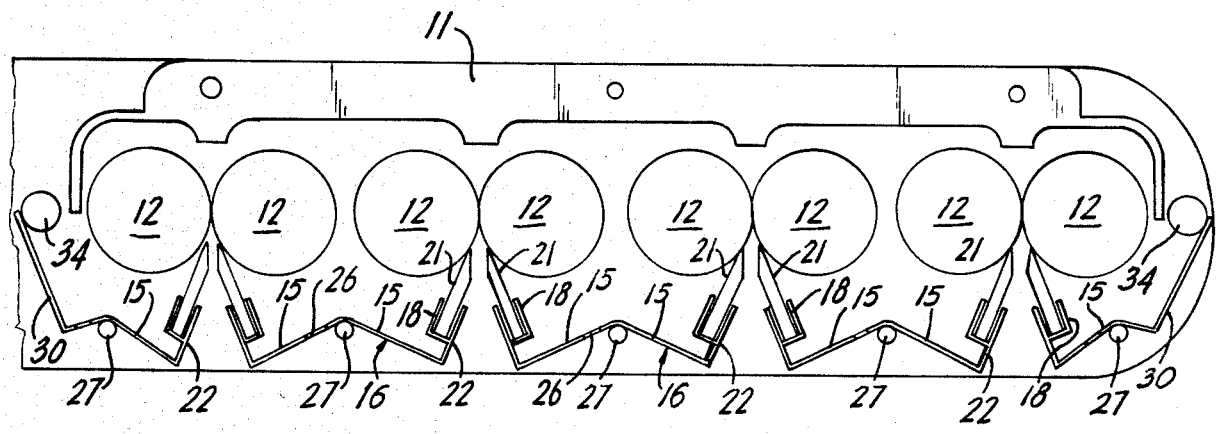
FIG. 2 is a section taken on the line 2—2 of FIG. 1.

Each pair of roller cutters 12 includes an axial array of lands 13 and grooves 14, as seen in FIG. 1, and are assembled such that the cooperating rollers of each pair intermesh lands and grooves to provide the cutting surfaces. The axial dimension across the land and the groove, respectively, are approximately equal allowing clearance only to effectively intermesh, thereby creating a shearing/cutting action as the counter-rotating rollers 12 to draw the dough through the roll bite and exit therefrom as a plurality of individual, discrete strips of predetermined width. The axial dimension of the lands and grooves determine the width of the noodle being cut. FIGS. 1 and 2 by way of illustration only, show pairs of roller cutters 12 with four discrete operating widths, each corresponding to a particular type noodle to be produced.

Figure 4:
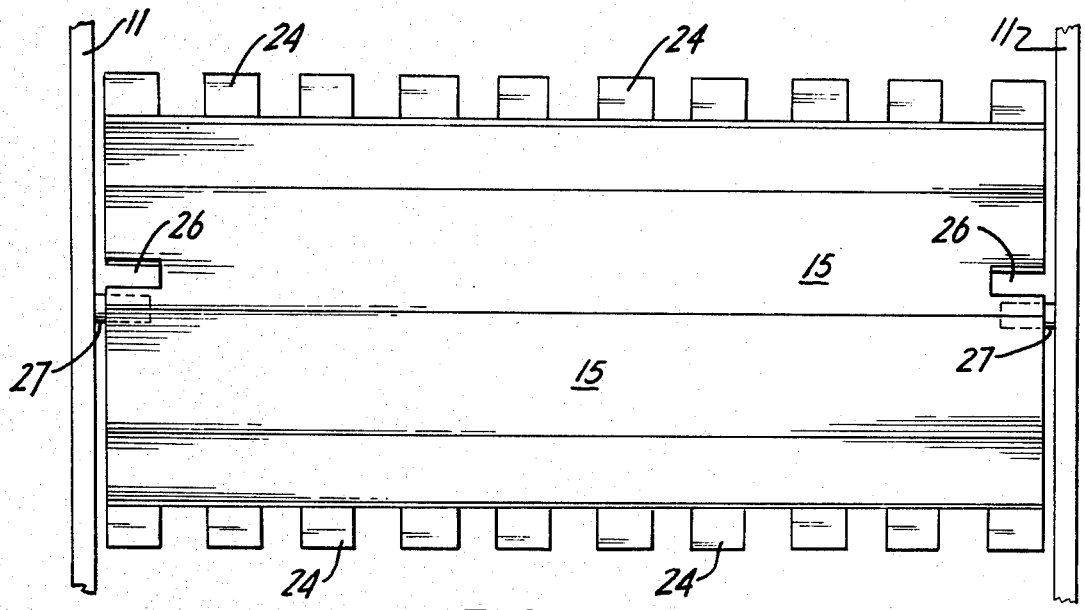
FIG. 4 is a plan view of the stripper comb assembly.

Disposed on the exit side of the pairs of roller cutters 12 are a plurality of stripper comb assemblies, generally designated 16, incorporating the principles of this invention. Each stripper comb assembly 16 comprises an elongate base comb holder member 17 formed of resilient sheet metal and preformed to be in the shape of a "W" in cross section. As best shown in FIG. 4 such comb holder member is of a length to extend across the roller cutters 12 and fit within the frame 11. Preferably it is formed of a rectangular piece of sheet metal bent to form a pair of inboard panels 15 connected at an angle to each other and forming the central legs of the "W" and a pair of outboard panels 22 forming the outer legs of the "W". The outer legs 22 of the comb holder member 17 include a pair of parallel spaced wall portions 18 defining an elongate marginal slot 19 extending across the full length of the member 17.

Disposed within the marginal slots 19 is the base portion 20 of a stripper comb member 21, which base portion 20 is removably retained therein by the biasing spring action of the wall portions 18 forming the slot 19. Each stripper comb member 21 includes a plurality of extending teeth 23 that are sized and spaced to be contained within the roller grooves 14 with the terminal ends thereof normally biased into sliding compressive relation with the base portion of said grooves. The end portions of said extending teeth 23 are desirably tapered to form a chisel-like point 24 that rides against the roller cutter surface to provide for efficient stripping of any of the cut strips that adhere thereto.

The resilient character of the W-shaped comb holder member 17 is multifunctional in nature. Not only does it serve to maintain the tooth members of the combs normally biased in tangential sliding compressive relation with the bases of the grooves 14 in the roller cutters 12 and automatically accommodate wear at the ends of the comb teeth but it also serves to accommodate a simple and positive readily removable installation thereof.

Figure 3:
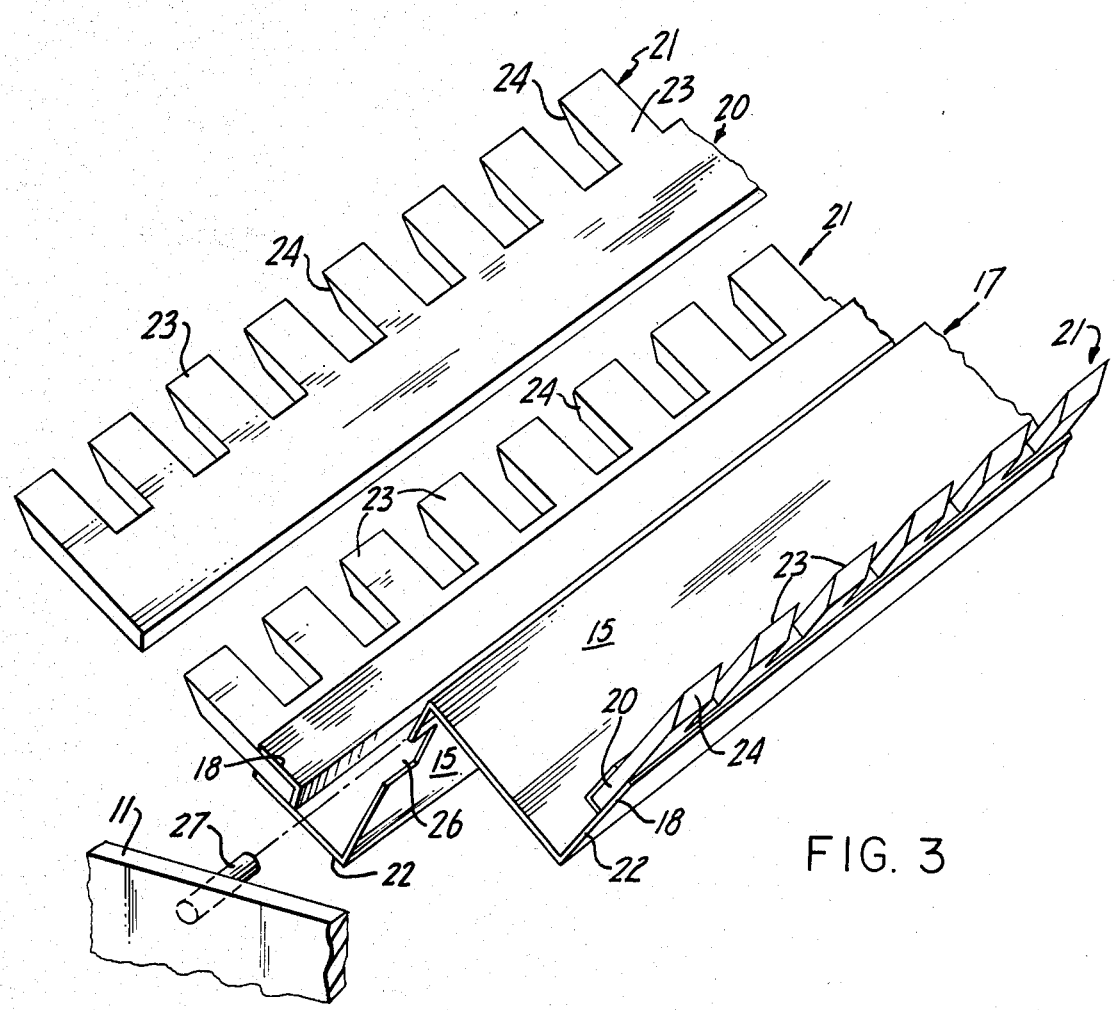
FIG. 3 is an oblique view of the stripper comb assembly with one comb member being disposed adjacent to its receiving socket.

To the above ends, a pair of pivot pins 27 are mounted in coaxial relation and extending inwardly from the side frames 11. As best shown in FIGS. 3 and 4, each of the comb holder members contain slots 26 in the end marginal edges thereof sized to accommodate and permit passage therethrough of the pivot pins 27. As will now be apparent, the resilient and elastically deformable character of the W-shaped comb holder members 17 permits the introduction of the midportion thereof inwardly of the pivot pins 27 through passage of the slots 26 therepast and subsequent location of the comb holder members 17 with the pivot pins 27 being disposed in the apex of the peaked midportion thereof as shown in FIG. 2. When in such position the members 17 are spring biased in fixed operating relation to the roller cutters with the extending ends of the teeth on the stripper comb members 21 being disposed in sliding, compressive tangential relation with the bottom of the grooves in the roller cutters 12 to perform their stripping function.

As will now also be apparent, the comb holder member 17 and stripper combs 23 associated therewith are maintained in operative position through the spring biasing of the comb holders 17 and the resilience of the combs 23 which may be suitably formed of molded plastic, such as Delrin or other flexible, abrasive resistant material.

As best shown in FIG. 2, the stripper comb assemblies 16 disposed at each of the ends of the roller cutter assembly have only one stripper comb member 21 removably mounted on the inboard arm of the W-shaped comb holder base member 17. The outboard arm 30 thereof is of a length to be tangent to a transverse brace or cross bar 34 forming part of the roller cutter frame assembly.

As will be apparent from FIG. 2 of the drawings, each comb holder member 17 operates to bridge adjacent pairs of roller cutters 12, that is to say one of the removable stripper comb members 20 will have teeth appropriately sized to operate with one width of cutter groove, whereas the second removable stripper comb member 20 associated therewith will have its teeth appropriately sized to operate with the groove widths on the adjacent pair of roller cutters 12.

From the foregoing, it is readily seen that the subject invention provide an easily installed and removed stripper comb assembly for noodle cutting machines that is of self tensioning and self aligning character. In addition to the foregoing, and the protective shrouding of the nip area between adjacent pairs of roller cutters, the ability to remove and replace the stripper combs 21, which are selectively sized to operatively mate with particular roller cutters 12 not only facilitates easy maintenance but also permits salvaging of stripper combs 21 with broken teeth by severing such units and forming a stripper comb member from a plurality of subsections thereof.

Having thus described my invention, I claim:

1. An improved construction for alimentary paste noodle cutting machines comprising a pair of side frame members disposed in parallel spaced relation, at least a first and second pair of counter rotating roller cutters mounted therebetween for severing introduced alimentary paste sheet material into discrete noodle strips, each pair of counter rotating roller cutters having a plurality of complementally intermeshing lands and grooves on the facing surfaces thereof whose axial dimensions are determinative of the width of severed noodle product emanating from the base portion of the grooves therein, a stripper comb holder of elastically deformable material having a generally W-shaped cross section and of a transverse extent to substantially span the distance between said side frame members, said generally W-shaped comb holder having a pair of downwardly directed and angularly diverging inboard arm members transversely joined to form an upwardly directed transversely disposed intermediate apex and pair of upwardly directed diverging outboard arm members each joined to a dependent end of one of said inboard arm members and terminating in first and second exposed marginal edges disposed in substantially parallel spaced relation with said transversely disposed intermediate apex, stripper comb mounting means associated with the first and second exposed marginal edges of said outboard arm members of said comb holder, stripper combs each having a base portion removably engageable with said mounting means and a plurality of terminally tapered stripping teeth complementally sized to be contained within the grooves on said roller cutters extending outwardly therefrom, and means extending inwardly from said side frame members intermediate said first pair and said second pair of roller cutters for supporting said intermediate apex of said comb holder to spring bias the ends of said teeth of stripper combs counted in said mounting means in tangential compressive relation with the surface of said grooves in one of said roller cutters forming the first pair thereof and in the adjacent roller cutter of the second pair thereof.

2. The noodle cutter construction as set forth in claim 1 wherein said stripper comb is formed of resilient plastic material.

3. The noodle cutter construction as set forth in claim 1 wherein said stripper comb mounting means each comprises a transversely disposed U-shaped receptacle sized to compressively receive and retain the base portion of said stripper combs.

4. An improved stipper comb assembly for alimentary paste noodle cutting machines of the type having a pair of side frame members disposed in parallel spaced relation and at least a first and second pair of landed and grooved counter rotating roller cutters mounted therebetween for severing introduced alimentary paste sheet material into discrete noodle strips comprising a stripper comb holder of elastically deformable material having a generally W-shaped cross section of a transverse extent to substantially span the distance between said side frame members, said generally W-shaped comb holder having a pair of downwardly directed and angularly diverging inboard arm members transversely joined to form an upwardly directed transversely disposed intermediate apex and a pair of upwardly directed diverging outboard arm members each joined to a dependent end of one of said inboard arm members and terminating in first and second exposed marginal edges disposed in substantially parallel spaced relation with said transversely disposed intermediate apex, stripper comb mounting means associated with at least one of said exposed marginal edges of said outboard arm members, and a stripper comb having a base portion removably engageable with said mounting means and a plurality of terminally tapered stripping teeth extending outward therefrom.

5. A stripper comb assembly as set forth in claim 4 wherein said stripper comb mounting means comprises a transversely disposed U-shaped receptacle sized to compressively receive and retain the base portion of said stripper comb.

* * * * *